US006375422B1

(12) United States Patent
Bingham

(10) Patent No.: US 6,375,422 B1
(45) Date of Patent: Apr. 23, 2002

(54) APPARATUS FOR PUMPING LIQUIDS AT OR BELOW THE BOILING POINT

(75) Inventor: Dennis N. Bingham, Idaho Falls, ID (US)

(73) Assignee: Bechtel BWXT Idaho, LLC, Idaho Falls, ID (US)

( * ) Notice: Subject to any disclaimer, the term of this patent is extended or adjusted under 35 U.S.C. 154(b) by 0 days.

(21) Appl. No.: 09/627,461

(22) Filed: Jul. 28, 2000

(51) Int. Cl.[7] ..... F04D 29/44
(52) U.S. Cl. ..... 415/203; 416/232; 416/235
(58) Field of Search ..... 416/223 B, 236 R, 416/235, 232, 223 R; 415/200, 203

(56) References Cited

U.S. PATENT DOCUMENTS 6,146,094 A * 11/2000 Obana et al. ..... 415/200
6,152,691 A * 11/2000 Thut ..... 415/197
6,210,116 B1 * 4/2001 Kuczaj et al. ..... 416/185
6,254,340 B1 * 7/2001 Vild et al. ..... 415/200

* cited by examiner

*Primary Examiner*—Edward K. Look
*Assistant Examiner*—Richard Edgar
(74) *Attorney, Agent, or Firm*—Dahl & Osterloth, LLP

(57) ABSTRACT

A pump comprises a housing having an inlet and an outlet. An impeller assembly mounted for rotation within the housing includes a first impeller piece having a first mating surface thereon and a second impeller piece having a second mating surface therein. The second mating surface of the second impeller piece includes at least one groove therein so that at least one flow channel is defined between the groove and the first mating surface of the first impeller piece. A drive system operatively associated with the impeller assembly rotates the impeller assembly within the housing.

21 Claims, 6 Drawing Sheets

APPARATUS FOR PUMPING LIQUIDS AT OR BELOW THE BOILING POINT

CONTRACTUAL ORIGIN OF THE INVENTION

This invention was made with United States Government support under Contract No. DE-AC07-94ID13223, now Contract No. DE-AC07-99ID13727 awarded by the United States Department of Energy. The United States Government has certain rights in the invention.

FIELD OF INVENTION

This invention relates to pumps in general and more specifically to a cryogenic pump for pumping a liquid at or below the boiling point.

BACKGROUND OF THE INVENTION

Various types of pumps and pumping apparatus are well-known in the art and have been used for decades, and in many cases for centuries, to pump any of a wide variety of materials. One common type of pump is the centrifugal pump, so named because it pumps the material by centrifugal action, i.e., by using a spinning impeller to accelerate the material being pumped radially outward into a surrounding casing or chamber. Centrifugal pumps come in a wide range of sizes and configurations and may be used in a wide range of applications. For example, centrifugal pumps are commonly used to pump water and other liquids. Centrifugal pumps may be used to pump gases as well and are commonly used in superchargers and in turbo-superchargers for internal combustion engines to compress or pump the intake charge (e.g, air or a fuel/air mix) into the engine. Centrifugal pumps or compressors have also been used in jet engines.

Centrifugal pumps typically comprise an impeller that is mounted for rotation within a casing or chamber. The impeller usually comprises a round or circular member having a central axis or hub about which the impeller rotates. The impeller is also provided with one or more blades or vanes which extend generally radially outward from the hub to the outer circumference of the impeller. The pump inlet is provided at or near the hub or inner radius of the impeller. The outlet is usually provided at one or more locations in the chamber or casing that surrounds the outer circumference of the impeller. Once the impeller is set in motion (i.e., rotated) the material being pumped is accelerated radially outward by the spinning vanes or blades on the impeller. The velocity imparted to the material is converted into pressure in the casing that surrounds the impeller and is commonly referred to as the diffuser section or simply, the diffuser. The pressurized material is then drawn-off through the one or more pump outlets provided. The material required to replace the material accelerated by the impeller is drawn into the pump inlet near the hub of the impeller.

It is well-known to provide the impeller vanes or blades with different shapes depending on the type of material being pumped and on the performance parameters (e.g., pressure ratio, discharge velocity, pumping stability, etc.) desired for the particular application. Many pumps are provided with radially oriented blades or vanes, as they tend to be the easiest to manufacture. However, other blade configurations may be better for certain applications. For example, centrifugal compressors have been produced with forward curved blades (i.e., blades that are curved in the direction of rotation of the impeller) and backward curved blades (i.e., blades that are curved in the direction opposite the direction of rotation of the impeller). Generally speaking, forward curved blades provide a greater pressure ratio or "head" for a given volume flow rate (at constant impeller rpm), with radial blades and backward curved blades providing progressively lower pressure ratios at the same volume flow rate. However, other considerations associated with the particular application may dictate whether the best arrangement is to have forward, backward, or radial impeller blades or vanes.

It is also generally desired to vary the cross-sectional areas defined by the flow passages created between adjacent blades or vanes on the impeller. For example, in certain applications it may be desirable for the cross-sectional area of a given flow passage to decrease with radial distance from the hub. In other applications, it may be desirable for the cross-sectional area to remain constant, or even increase, with increasing radial distance. Impellers having such cross-sectional area variations have been designed and are being used, but typically involve complex shapes which can only be formed by casting processes.

While centrifugal pumps of the type described above work well and are being used, they still are not without their disadvantages. For example, the impellers used in such pumps are typically formed by casting and may need to be subsequently machined depending the blade shape required. Furthermore, while it is possible to provide the flow channels defined by the blades or vanes with varying cross-sectional areas as a function of radial distance from the hub, impellers having such characteristics typically have complex shapes that are difficult and expensive to manufacture.

Another problem that currently exists in the field of material pumping relates to the pumping of liquids and other materials that are maintained at temperatures that are at or near their boiling points. The liquids involved in such applications are typically cryogenic liquids, such as liquid nitrogen, liquid oxygen, and others, although there are also occasions wherein the liquids are not cryogenic. The pumping of a liquid that is at or near its boiling point is difficult because the reduced pressures located in the inlet portions of the pump can cause the liquid to boil, resulting in pump cavitation and a loss of pumping efficiency. Such boiling problems are often made worse if the pump body is warmer than the liquid being pumped. In such cases, heat from the pump body and other components is transferred to the liquid being pumped. The extra heat is often sufficient to boil the liquid which, again, can lead to cavitation and a loss of pumping efficiency.

Consequently, a need remains for a pump having an impeller that can be quickly and easily manufactured while at the same time allowing the flow passages defined by the impeller to be formed with any of a wide range of cross-sectional areas and configurations in order to optimize pump operation. Other advantages could be realized if a pump having such an improved impeller design could be used to pump liquids at or near their boiling points, but with a reduced likelihood that the liquid will vaporize and/or boil as it is being pumped.

SUMMARY OF THE INVENTION

A pump according to the present invention may comprise a housing having an inlet and an outlet. An impeller assembly mounted for rotation within the housing includes a first impeller piece having a first mating surface thereon and a second impeller piece having a second mating surface therein. The second mating surface of the second impeller piece includes at least one groove therein so that at least one flow channel is defined between the groove and the first mating surface of the first impeller piece. A drive system operatively associated with the impeller assembly rotates the impeller assembly within the housing.

BRIEF DESCRIPTION OF THE DRAWINGS

Illustrative and presently preferred embodiments of the invention are shown in the accompanying drawing in which.

DETAILED DESCRIPTION OF THE INVENTION

Figure 1:
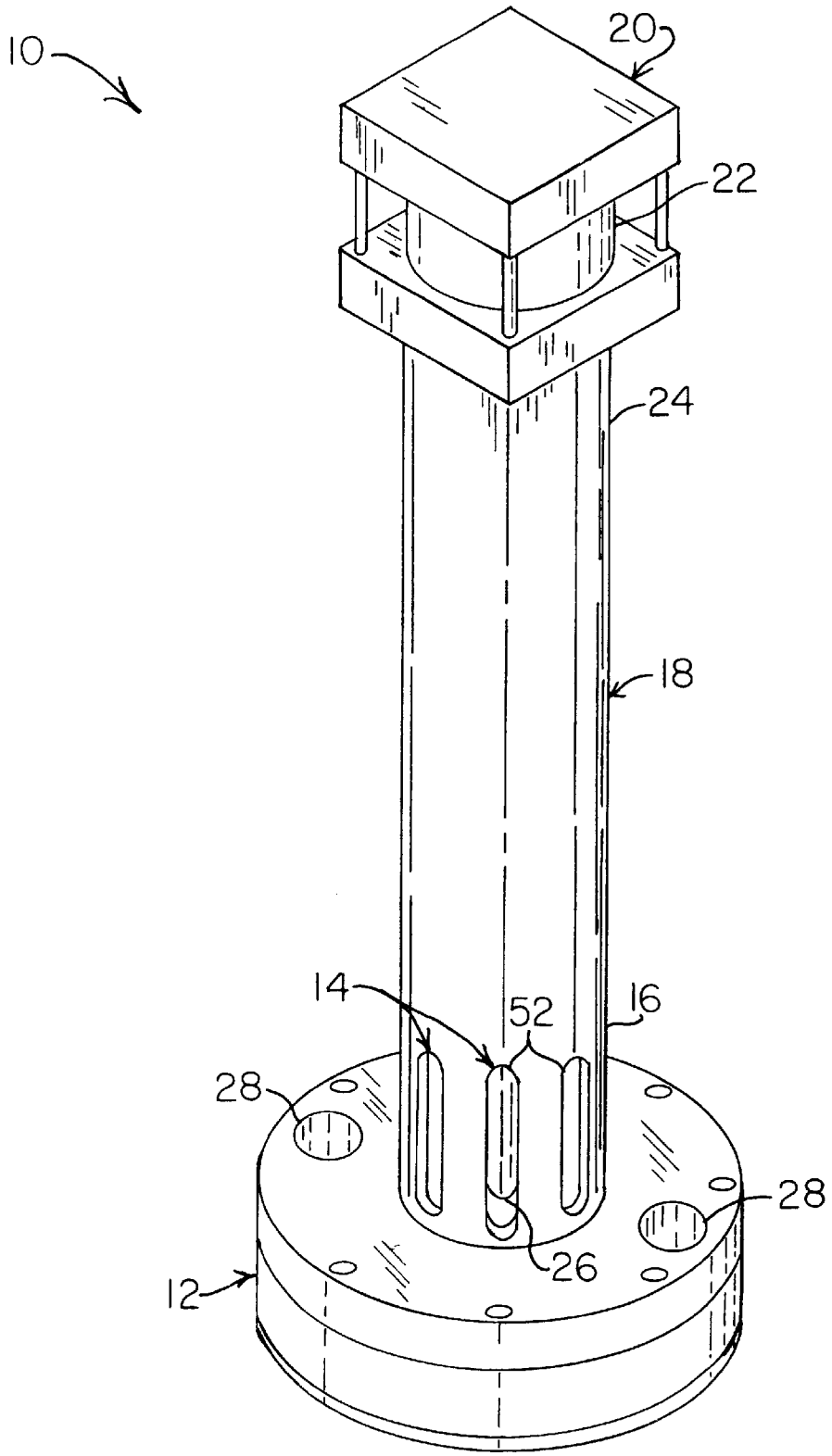
FIG. 1 is a perspective view of one embodiment of a pump according to the present invention that is suitable for pumping liquids at or below the boiling point.
Figure 2:
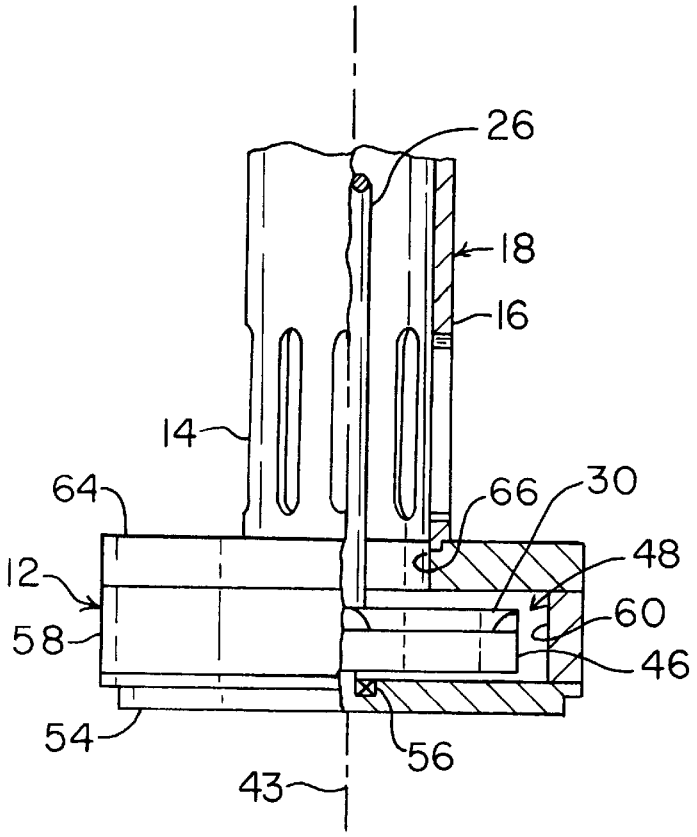
FIG. 2 is a side view in elevation of the lower portion of the pump, with portions of the support column and pump housing broken away to reveal the two piece impeller assembly.
Figure 3:
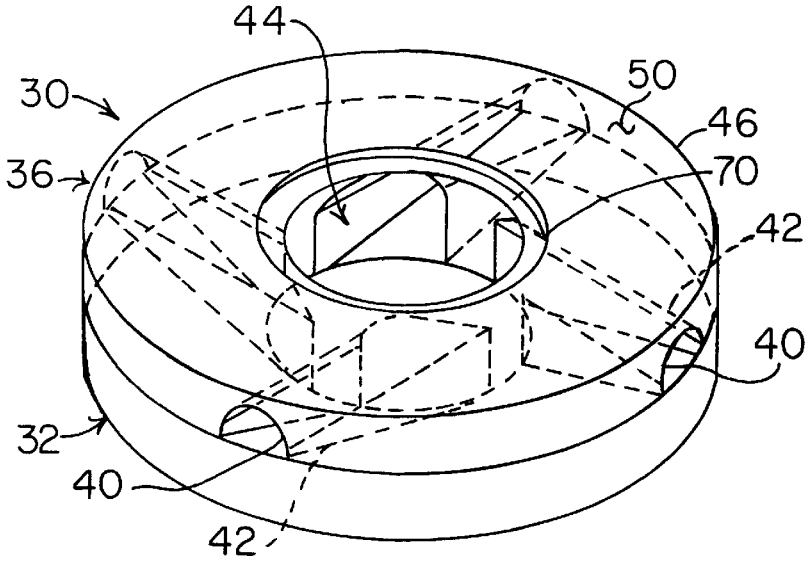
FIG. 3 is a perspective view of the two piece impeller assembly according to the present invention.

A pump 10 according to one embodiment of the present invention is best seen in FIGS. 1–3 and may be used for pumping a liquid, particularly a cryogenic liquid, at temperatures that are at or below the boiling point for the liquid. Alternatively, other types of liquids, and even gases, may also be pumped with the present invention, as will be described in greater detail below. In the embodiment shown and described herein, the pump 10 may comprise a submersible, sump-type configuration designed to be positioned within a sump (not shown) containing the liquid (also not shown) to be pumped. More specifically, the pump 10 is provided with a pump body or housing 12 positioned at the lower end 16 of a support column 18 so that the pump body 12 will be submerged within the liquid contained within the sump. A drive system 20, such as a motor 22, is positioned at the upper end 24 of the support column 18, so that the drive system 20 remains above the level of the liquid contained within the sump. The drive system 20 is connected to the pump housing 12 via a drive shaft 26 contained within the support column 18. An inlet 14 may be provided at the lower end 16 of support column 18 so that the inlet 14 is below the level of the liquid within the sump. One or more outlets 28 may be provided on the pump housing 12, as best seen in FIG. 1. The outlets 28 may be connected to a discharge pipe or conduit (not shown) suitable for carrying the liquid to the desired location.

Figure 4:
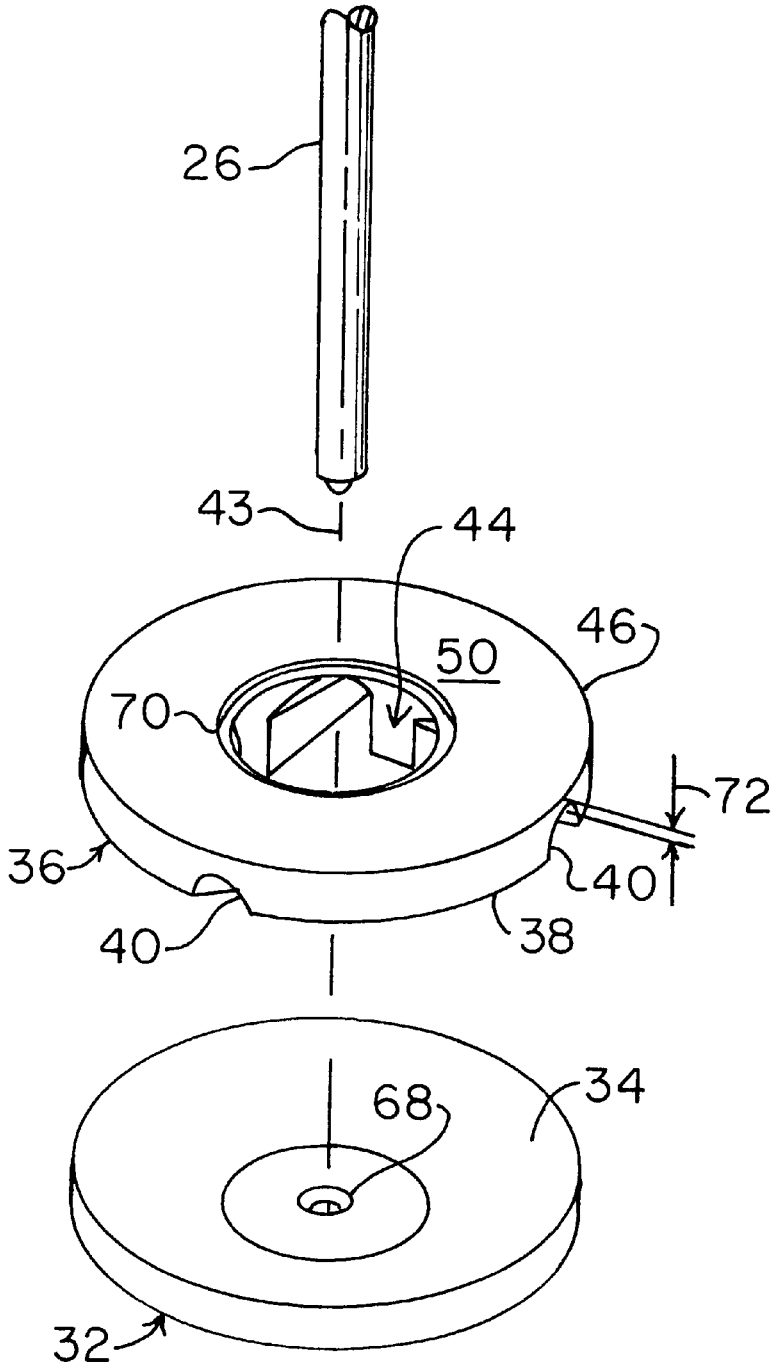
FIG. 4 is an exploded perspective view of the two piece impeller assembly and drive shaft.
Figure 5:
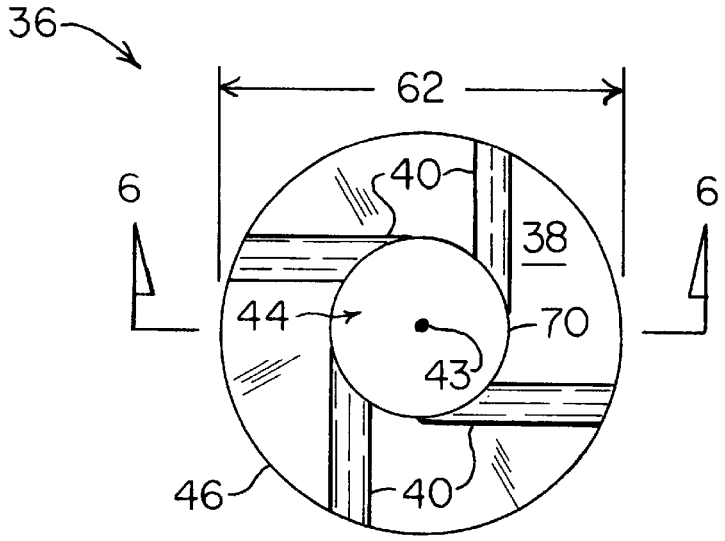
FIG. 5 is a plan view of the mating surface of the upper impeller piece showing the orientations of the grooves provided therein.
Figure 6:
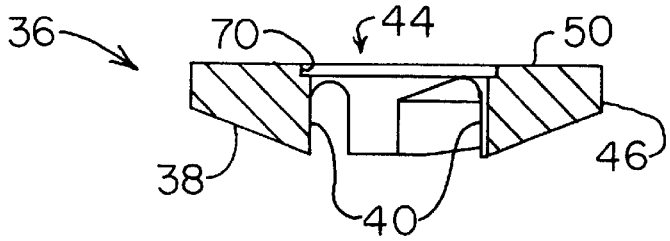
FIG. 6 is a sectional side view of the upper impeller piece taken along the line 66 of FIG. 5.

With reference now primarily to FIGS. 2, 3 and 4, the pump housing 12 may comprise a generally circular member sized to receive for rotation therein a two-piece impeller assembly 30. The two-piece impeller assembly 30 may comprise a first or lower impeller piece 32 having a mating surface 34 provided thereon. A second or upper impeller piece 36 is provided with a mating surface 38 thereon. The mating surface 38 of the upper impeller piece 36 is sized and shaped to mate with the mating surface 34 provided on the lower impeller piece 32 so that the two mating surfaces 34 and 38 fit tightly together. The mating surface 38 of upper impeller piece 36 is provided with at least one, and preferably a plurality, of grooves 40 therein that extend generally radially outwardly, as best seen in FIG. 5. The groove or grooves 40 provided in the mating surface 38 of the upper impeller piece 36, together with the mating surface 34 on the lower impeller piece 32, define respective flow channels 42 when the lower and upper impeller pieces 32, 36 are mounted together to form the two piece impeller assembly 30. See FIG. 3.

As will be described in greater detail below, the mating surfaces 34 and 38 of the respective lower and upper impeller pieces 32 and 36 may comprise any of a wide range of shapes or configurations. For example, in the embodiment shown and described herein, the mating surfaces 34 and 38 comprise truncated cones. That is, each mating surface 34 and 38 defines a portion of a cone. Alternatively, the mating surfaces 34 and 38 may define any of a wide range of other shapes. For example, in another embodiment of the invention the mating surfaces 34 and 38 may define portions of any of the so-called conic sections (e.g., a circle, an ellipse, a parabola, and a hyperbola), as will be discussed below.

The shape defined by the mating surfaces 34 and 38 of the lower and upper impeller pieces 32 and 36 allow the channel or channels 42 defined by the groove or grooves 40 and the mating surface 34 on the lower impeller piece 32 to comprise any of a is wide range of variable cross-sections to optimize certain pump parameters (e.g., pressure ratio, discharge velocity, etc.). For example, in the embodiment illustrated in FIG. 3, each channel 42 defined by the two piece impeller assembly 30 has a cross-sectional area that decreases with increasing radial distance from the central axis 43 of the impeller assembly 30. Such a decreasing cross-sectional area is provided by the generally concave mating surface 34 of the lower impeller piece 32 and the generally convex mating surface 38 of the upper impeller piece 36. In another embodiment, the channel or channels 42 may be provided with increasing cross-sectional areas with increasing radial distance by providing a generally convex mating surface 34 on the lower impeller piece 32 and a generally concave mating surface 38 on the upper impeller piece 36.

The rate of area decrease/increase of the channels 42 can be made to vary by changing the shape function of the mating surfaces 34 and 38. For example, if the shape function of the surfaces is linear, as in the case of a truncated cone, the rate of cross-section variation will also be linear (for grooves 40 of constant width and distance from the top surface 50 of upper impeller piece 36). Conversely, if the shape function of the surfaces 34 and 38 is non-linear, so will be the rate of area change. Accordingly, the pump 10 according to the present invention may be configured to provide any of a wide range of pumping parameters and operating points for a wide range of materials by simply providing the mating surfaces 34 and 38 with the desired shape.

The pump 10 operates in a manner akin to a conventional centrifugal pump, wherein the material being pumped is moved or carried from the center inlet region 44 of the impeller 30 outward to the outer periphery 46 of the impeller 30. More specifically, the drive system 20 (e.g., motor 22) rotates the impeller assembly 30 within the pump housing 12. The rotating impeller 30 draws in the material being pumped through the inlet 14, through the center inlet region 44 of the impeller 30 and thence outward through the channels 42 defined by the two impeller pieces 32 and 36. After exiting the channels 42 at the outer periphery 46 of the impeller 30, the material is discharged into an annular region or diffuser 48 defined between the outer periphery 46 of impeller 30 and the pump housing 12. See FIG. 2. Thereafter, the material being pumped is discharged from the outlets 28 provided in the pump housing 12, as best seen in FIG. 1.

A significant advantage of the pump 10 according to the present invention is that it is particularly useful in the pumping of liquids, particularly cryogenic liquids, having temperatures that are at or below their boiling points. The sump-type configuration of the pump 10 allows the pump housing 12 and impeller 30 to be substantially submerged within the liquid (not shown) being pumped. The surrounding liquid acts a heat sink, thus helping to maintain the various components of the pump 10 at the temperature of the surrounding liquid. This reduces the tendency of the liquid contained within the pump to boil (i.e., vaporize), which can result in cavitation and a loss of pumping efficiency. The sump-type configuration of the pump 10 also allows the drive system 20 to be elevated above the level of the liquid being pumped, thereby preventing the heat generated by the drive system 20 from being transferred into the liquid being pumped.

Still other advantages are associated with the two piece impeller assembly 30. The two piece impeller assembly 30 is extremely easy to manufacture and does not require any complicated casting and/or machining steps. The impeller assembly 30 may be quickly and easily fabricated with any of a wide variety of computer controlled machine tools which are readily commercially available. For example, in the embodiment shown and described herein, the lower impeller piece 32 may be manufactured from bar-stock material, with the cone-shaped concave mating surface 34 being formed on a lathe or by a milling machine. The convex cone-shaped mating surface 38 on the upper impeller piece 36 may be similarly formed. The grooves 40 in the mating surface 38 on the upper impeller piece 36 may be formed with the aid of a milling machine and a conventional ball-end mill.

As mentioned above, the provision of the lower and upper impeller pieces 32 and 36 with the respective concave/convex mating surfaces 34 and 38 allows the flow channels 42 defined by the grooves 40 and the mating surface 34 of-the lower impeller piece 32 to be provided with decreasing cross-sectional areas (as a function of the radial distance from the central axis 43), but without requiring any complicated machining or forming of the grooves 40 so that they have varying cross-sectional areas. For example, in the embodiment shown and described herein, the grooves 40 are formed by means of constant-depth cut (with respect to the top surface 50 of the upper impeller piece 36) with a ball-end mill having a constant width. Therefore, the grooves 40 are formed in a manner akin to forming a channel having a constant cross-sectional area yet, when combined with the concave/convex meeting surfaces 34, 38, define channels having varying cross-sectional areas.

Having briefly described one embodiment of the pump 10 according to the present invention, as well as some of its more significant features and advantages, the various embodiments of the pump according to the present invention will now be described in detail. However, before proceeding with the description it should be noted that while the pump 10 according to the present invention may be used ideally and advantageously to pump liquids, particularly cryogenic liquids (e.g., liquid nitrogen, liquid oxygen, etc.), that are maintained at temperatures that are at and below the boiling points for such liquids, the pump 10 may be used to pump liquids at other temperatures. The pump 10 is not even limited pumping liquids and could be used to pump any of a wide range of other materials (e.g., slurries and gases) as well. Consequently, the present invention should not be regarded as limited to the pumping applications and materials shown and described herein.

With the foregoing considerations in mind, one embodiment of the pump 10 is best seen in FIGS. 1–3 and may be used to pump liquid nitrogen (not shown), although other materials may also be pumped. The liquid nitrogen may be contained in a sump (also not shown). The pump 10 may comprise a sump-type configuration in which the pump body 12 and impeller 30 are submerged in the liquid (e.g., liquid nitrogen) contained in the sump. Accordingly, the pump body 12 is mounted to the lower end 16 of an elongate support column 18 in the manner best seen in FIG. 1. The lower end 16 of support column 18 may be provided with one or more slots 52 which define the pump inlet 14. In order to prevent air (or other gases) from being drawn into the pump 10, the upper ends of each of the slots 52 should be well below the minimum anticipated level of the liquid contained within the sump in which the pump 10 is submerged. The drive system 20, e.g., motor 22, for the pump 10 may be mounted to the upper end 24 of the support column 18. The length of the support column 18 should be sufficient so that the drive system 20 is maintained above the maximum anticipated level of the liquid (not shown) contained within the sump (not shown) in which the pump 10 is submerged. The drive system 20 may be operatively connected to the impeller assembly 30 by any convenient drive coupling, such as by a drive shaft 26.

The various components just described may be fabricated from any of a wide range of materials suitable for the intended application. By way of example, in the embodiment shown and described herein, the pump body 30, the support column 18, and the drive shaft 26 are fabricated from stainless steel. Alternatively, other materials that are now known in the art or that may be developed in the future, may also be used, as would be obvious to persons having ordinary skill in the art after having become familiar with the teachings of the present invention.

The drive system 20 may comprise any of a wide range of drive systems suitable for rotating the impeller assembly 30 at the speed required to pump the material (e.g., liquid nitrogen) at the desired flow rate. By way of example, the drive system 20 utilized in one preferred embodiment of the invention may comprise an electric motor 22. However, since drive systems for centrifugal pumps are well-known in the art and could be easily provided by persons having ordinary skill in the art after having become familiar with the teachings of the present invention, the particular drive system 20 that may be utilized in one preferred embodiment of the present invention will not be described in further detail herein.

With reference now primarily to FIG. 2, the pump body 12 may comprise a generally circular member sized to receive for rotation therein the two piece impeller assembly 30. In the embodiment shown and described herein, the pump body 12 comprises a generally circular bottom plate 54 which may be provided with a bearing 56 therein sized to receive the drive shaft 26. A generally ring-shaped or cylindrically shaped main body section 58 may be mounted to the bottom plate 54 and is provided with an inside diameter 60 that is greater than the outside diameter 62 (FIG. 5) of impeller 30 so that an annular region or diffuser section 48 is formed therebetween. The main body section 58 of pump body 12 may be surmounted by a top plate 64. Top plate 64 may be provided with an opening or inlet passage 66 therein that is sized to receive the lower end 16 of the support column 18, as best seen in FIG. 3. The inlet passage 66 allows the liquid to flow through the pump inlet 14 and into the rotating impeller assembly 30. Top plate 64 may also be provided with a pair of outlets 28 therein (FIG. 1) through which is discharged the material being pumped. The pump outlets 28 may be provided with NPT-type pipe threads (not shown) to allow a suitable discharge pipe or conduit (not shown) to be attached to the outlets 28. Alternatively, other types of pipe connection systems and devices may be used, as would be obvious to persons having ordinary skill in the art after having become familiar with the teachings of the present invention.

The various component parts (e.g., bottom plate 54, main body 58, and top plate 64) comprising the pump body 12 may be fabricated from any of a wide range of materials suitable for the intended application and the material to be pumped. By way of example, in one preferred embodiment, the bottom plate 54, main body 58, and top plate 64 are fabricated from stainless steel. Alternatively, other materials may be used, as would be obvious to persons having ordinary skill in the art after having become familiar with the teachings of the present invention.

The various component parts (e.g., 54, 58, and 64) of the pump body 12 may be held or mounted together by any of a wide range of fastening systems and devices now known in the art or that may be developed in the future. In the embodiment shown and described herein, the bottom and top plates 54 and 64 are fastened to the main body section 58 by means of machine screws (not shown) in the manner that would be obvious to persons having ordinary skill in the art.

The two piece impeller assembly 30 is best seen in FIGS. 3—7 and comprises a lower impeller piece 32 and an upper impeller piece 36 which are fastened together so that the two impeller pieces 32, 36 rotate together. For example, in the embodiment shown and described herein, the lower and upper impeller pieces 32 and 36 are fastened together by machine screws (not shown). Alternatively, other types of fastening systems now known in the art or that may be developed in the future may also be used.

Figure 7:
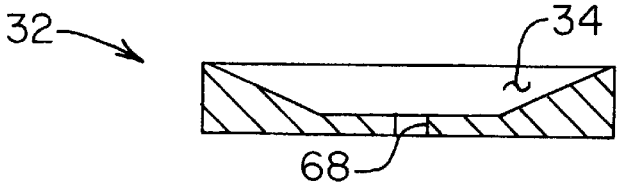
FIG. 7 is a sectional side view of the lower impeller piece.

Referring now to FIGS. 4 and 7, the lower impeller piece 32 may comprise a generally circular, plate-like member having a mating surface 34 provided therein which is sized to mate with the mating surface 38 provided on the upper impeller piece 36. The lower impeller piece 32 may also be provided with a hole or passageway 68 therein sized to receive the drive shaft 26 so that the lower impeller piece 32 is connected to the drive shaft 26 and is rotated thereby. In one preferred embodiment, the drive shaft 26 may be secured to the lower impeller piece 32 by a threaded fastener (not shown) that may be screwed into threads (also not shown) provided in the end of the drive shaft 26. The threaded fastener (not shown) may be provided with a head (also not shown) sized to be received by the bearing 56 provided in the bottom plate 54 of the pump body 12. Alternatively, the drive shaft 26 may be secured to the lower impeller piece 32 by other means (e.g., by a slotted keyway), in which case the end of the drive shaft 26 may be journalled directly in the bearing 56. In any case, since the connection of the lower impeller piece 32 to the end of the drive shaft 26 and the journalling of the drive shaft 26 in the bottom plate 54 could be accomplished in accordance with any of a wide variety of arrangements well-known in the art, the particular arrangement utilized in one preferred embodiment of the invention will not be described in greater detail herein.

The upper impeller piece 36 may also comprise a generally circular, plate-like member having a mating surface 38 sized to mate with the mating surface 34 of the lower impeller piece 32. See FIGS. 4 and 6. The upper impeller piece 36 may also be provided with a central hole 70 therein which defines the inlet region 44 of the impeller assembly 30. Inlet region 44 is in fluid communication with the inlet 14 (e.g., the slots 52) provided in the lower end 16 of the support column 18 via the inlet opening 66 provided in the top plate 64 of pump housing 12. See FIG. 3.

The upper impeller piece 36 may also be provided with one or more grooves 40 therein which extend between the inlet region 44 and the outer periphery 46 of the impeller assembly 30. See FIG. 5. The grooves 40 may be configured in any of a wide variety of positional orientations so that they extend generally radially outwardly between the inlet region 44 and the outer periphery 46. For example, in the embodiment shown and described herein, each groove 40 is oriented so that it is substantially tangential to the central hole or opening 70 in the upper impeller piece 36. Each groove 40 then extends straight out to the outer periphery 46 of the upper impeller piece 36. See FIG. 5. Alternatively, other configurations are possible. For example, in addition to being generally tangentially oriented with respect to the central opening 70, each groove 40 could be "forward curved" (i.e., in the direction of impeller rotation) or "backward curved" (i.e., in the direction opposite impeller rotation). As is well-known, different configurations (e.g., straight, forward, or backward orientations) of the grooves 40 will produce different pressure ratios and discharge velocities, which may be advantageous in certain applications or when pumping certain liquids. Consequently, the present invention should not be regarded as limited to grooves 40 having the particular orientations shown and described herein.

It is generally preferred, but not required, that the grooves 40 have a substantially constant "depth," i.e., so that the distance 72 (FIG. 4) between the top of the groove and the top surface 50 of upper impeller piece 36 is substantially constant. Such a constant "depth" or configuration is easy to machine, thus helping to achieve one of the objects of the present invention. Notwithstanding the constant-depth configuration of each groove 40, the cross-sectional area of each groove 40 can be made to vary in the radial direction by means of the shape functions provided to mating surfaces 34, 38, as will be described in greater detail below.

The lower and upper impeller pieces 32 and 36 may be fabricated from any of a wide range of materials, such as metals or plastics, that would be suitable for the intended application and for the type of material to be pumped. Consequently, the present invention should not be regarded as limited to impeller pieces fabricated from any particular material or type of material. However, by way of example, the lower and upper impeller pieces 32 and 36 utilized in one preferred embodiment of the present invention are fabricated from stainless steel.

As was briefly mentioned above, the shape function of the mating surfaces 34, 38 of the respective lower and upper impeller pieces 32 and 36 control the cross-sectional configuration of the flow channels 42 defined between the grooves 40 and the mating surface 34 of the lower impeller piece 32. For example, if the mating surface 34 of the lower impeller piece is generally concave, as illustrated herein, and if the grooves 40 comprise substantially constant width grooves having the same "depth" with respect to the top surface 50 of upper impeller piece 36, as described above, the channels 42 will have cross-sectional areas that decrease with increasing radial distance from the central axis 43 of impeller assembly 30. Flow channels 42 having such decreasing cross-sectional areas are generally desired when pumping liquids.

The cross-sectional areas of the channels 42 can be made to increase with increasing radial distance by reversing the "concavity" of the mating surfaces 34 and 38. For example, the cross-sectional areas of the flow channels 42 can be made to increase with increasing radial distance by making the mating surface 34 of the lower impeller piece 32 convex and the mating surface 38 of the upper impeller piece 36 concave. Flow channels 42 having increasing cross-sectional areas with increasing radial distance may be advantageous when pumping gases. Of course, flow channels 42 having substantially constant cross-sectional areas may be achieved by making both mating surfaces 34 and 38 substantially flat (i.e., planar), so that the mating surfaces 34 and 38 are generally perpendicular to the central axis 43.

The rate of cross-sectional area variation (i.e., either a decrease or an increase) can be controlled by the shape function that describes the concave or convex mating surfaces 34 and 38. For example, if the concave surface 34 of the lower impeller piece 32 (which makes the flow channels 42 have generally decreasing cross-sectional areas) comprises a section of a cone (i.e., a truncated cone), the rate of change of the cross-sectional area decrease will be substantially constant. That is, the cross-sectional areas of the channels 42 will decrease linearly. Non-linear cross-sectional area changes may be achieved by changing the shape or function used to define the mating surfaces 34 and 38. For example, if the mating surfaces comprise surfaces of revolution corresponding to portions of any of the so-called conic sections (i.e., a circle, an ellipse, a parabola, or a hyperbola), the cross-sectional areas of the channels 42 will vary in a non-linear manner with respect to radial distance. Such non-linear cross-sectional area variations could also be achieved by curving (i.e., spiraling) the grooves 40, as could be the case if the grooves 40 are curved in either the forward or backward directions. An example of such curved or spiraled grooves 40 would be grooves 40 that describe an epicycloid.

Figure 8:
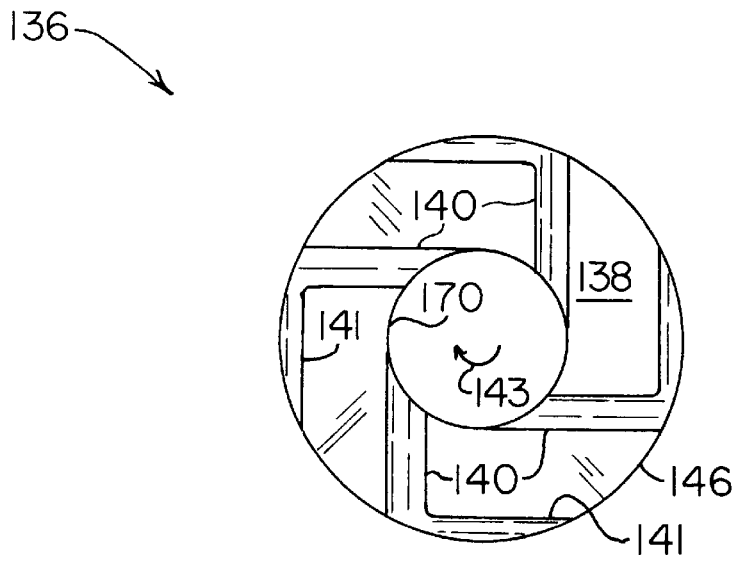
FIG. 8 is a plan view of a second embodiment of an upper impeller piece having a modified groove arrangement.

As mentioned above, the grooves 40 in the impeller assembly 30 may comprise a variety of configurations depending on the desired performance characteristics of the pump 10. For example, in another embodiment, the pump 10 according to the present invention may be provided with a modified upper impeller piece 136 shown in FIG. 8. The modified upper impeller piece 136 may be used with the lower impeller piece 32 shown and described above for the first embodiment. The modified upper impeller piece 136 comprises a circular, plate-like member having a mating surface 138 that is sized and shaped to mate with the mating surface 34 provided on the lower impeller plate 32 (FIG. 7). The mating surface 138 may be provided with a plurality of grooves 140 that extend generally radially outwardly from the central hole or inlet aperture 170 to the outer periphery 146. However, unlike the first embodiment of the upper impeller piece 36, each of the grooves 140 in the second embodiment 136 of the upper impeller piece includes an outer extension portion 141. The outer extension portions 141 are generally tangential to the outer periphery 146 of the upper impeller piece 136 and extend generally "backward" i.e., in the direction opposite the direction of rotation (indicated by arrow 143) of impeller piece 136. The extension portions 141 generally enhance (i.e., increase) the discharge pressure of the pump.

Figure 10:
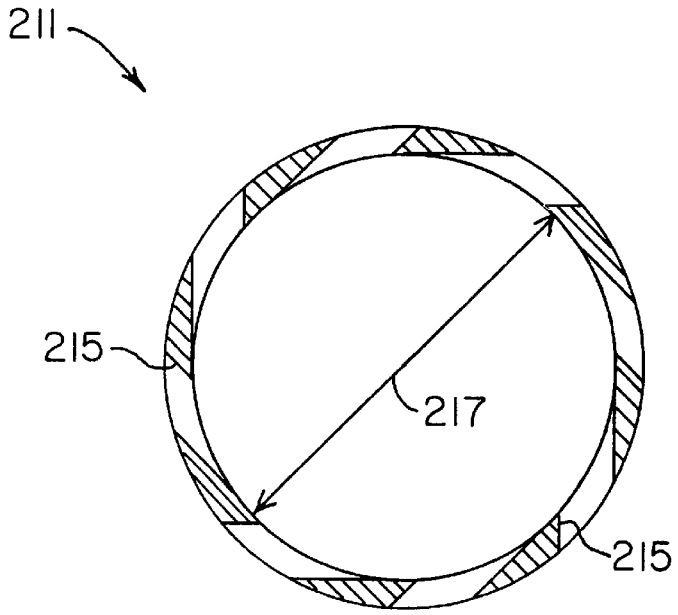
FIG. 10 is a sectional view of the inlet inducer pipe taken along the line 10—10 of FIG. 9.
Figure 9:
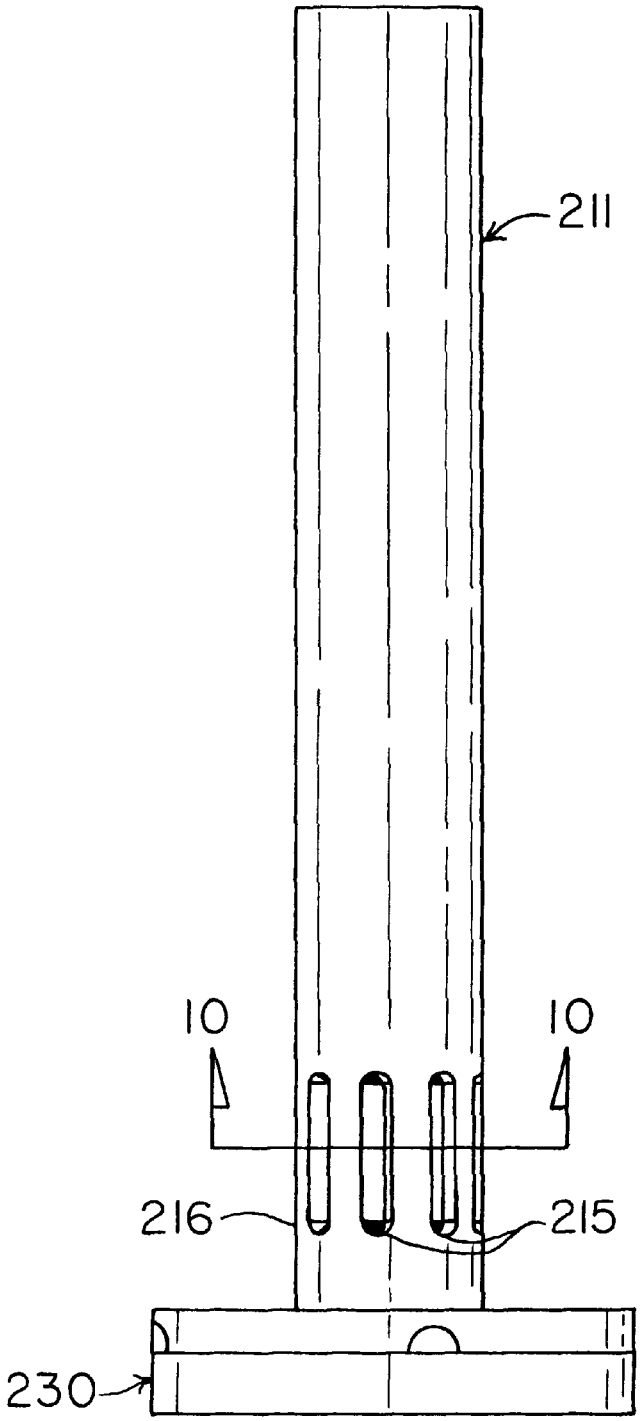
FIG. 9 is a perspective view of another embodiment of a pump having an inlet inducer pipe.

Still other variations and modifications are possible. For example, with reference now to FIGS. 9 and 10, some embodiments of the pump may be provided with an inlet inducer tube 211. Inlet inducer tube 211 extends generally upwardly from the central aperture (not shown in FIG. 9, but indicated generally in FIGS. 3–6 at 70) of the impeller assembly 210 and is surrounded by the support column 18 (FIG. 1). Inlet inducer tube 211 may be provided with one or more elongate inlet slots 215 therein which are generally tangentially oriented with respect to the inside diameter 217 of inducer tube 211. See FIG. 10. The tangentially oriented inlet slots 215 are located on the lower end 216 of inducer tube 211 so that they are generally axially aligned with the inlet slots 52 comprising the inlet 14 of support column 18 (FIG. 1). The tangential inlet slots 215 add pre-whirl to the fluid entering the inlet region (e.g., 44, FIG. 3) of impeller assembly 230, which may enhance performance under certain conditions.

This completes the detailed description of the various embodiments of the present invention. While a number of specific components were described above for the preferred embodiments of this invention, persons having ordinary skill in the art will readily recognize that other substitute components or combinations of components may be available now or in the future to accomplish comparable functions to the various components shown and described herein. For example, while the various embodiments of the pump that are shown and described herein contain the inlet on the top side of the pump, the inlet could be provided on the bottom side, or both the top and bottom sides. For example, the bottom plate 54 of housing 12 and the lower impeller piece 32 both may be provided with central openings therein to allow the fluid being pumped to be drawn into the impeller from the bottom side. Similarly, such openings may be provided on both the top and bottom sides to allow the pump to draw in material from both the top and bottom sides. Still other variations are possible. For example, the various grooves 40 may be provided in the lower impeller piece (e.g., 32) instead of the upper impeller piece (e.g, 36). In still another variation, the grooves 40 could be provided in both the upper and lower impeller pieces, and could either be aligned with one another or staggered.

Accordingly, it should be understood that the inventive concepts herein described may be variously otherwise embodied and it is intended that the appended claims be construed to include alternative embodiments of the invention except insofar as limited by the prior art.

I claim:

1. A pump, comprising:

a housing having an inlet and an outlet;

an impeller assembly mounted for rotation within said housing, said impeller assembly, comprising:

a first impeller piece having a first mating surface thereon;

a second impeller piece having a second mating surface therein, the second mating surface of said second impeller piece being sized to mate with the first mating surface of said first impeller piece, the second mating surface of said second impeller piece having at least one groove therein, said second impeller piece being mounted to said first impeller piece so that the second mating surface fits against the first mating surface, the groove in the second mating surface together with the first mating surface defining at least one flow channel in said impeller assembly; and a drive system operatively associated with said impeller assembly, said drive system rotating said impeller assembly within said housing.

2. The pump of claim 1, wherein the first mating surface of said first impeller piece comprises a concave surface and wherein the second mating surface of said second impeller piece comprises a convex surface.

3. The pump of claim 2, wherein said concave surface and convex surface comprise truncated cones.

4. The pump of claim 2, wherein said concave surface and said convex surface comprise conic sections.

5. The pump of claim 1, wherein said at least one flow channel extends from an inlet region located at a first radial position in said impeller assembly to an outlet region located at a second radial position in said impeller assembly, said second radial position being located radially outwardly from the first radial position.

6. The pump of claim 5, wherein said at least one flow channel has a first cross-sectional area at the first radial position and a second cross-sectional area at the second radial position, said first cross-sectional area being greater than the second cross-sectional area.

7. The pump of claim 5, wherein said at least one flow channel has a first cross-sectional area at the first radial position and a second cross-sectional area at the second radial position, said first cross-sectional area being about equal to the second cross-sectional area.

8. The pump of claim 5, wherein said at least one flow channel has a first cross-sectional area at the first radial position and a second cross-sectional area at the second radial position, said first cross-sectional area being less than the second cross-sectional area.

9. The pump of claim 5, wherein the inlet of said housing is in fluid communication with the inlet region of said impeller assembly and wherein the outlet of said housing is in fluid communication with the outlet region of said impeller assembly.

10. The pump of claim 1, wherein said housing defines a substantially cylindrical volume therein and wherein said impeller assembly has a substantially circular configuration having an outer periphery, said impeller assembly being mounted for rotation within said housing so that said impeller assembly is substantially concentric with the substantially cylindrical volume and so that an annular diffuser section exists around the outer periphery of said impeller assembly.

11. The pump of claim 1, wherein the first mating surface of said first impeller piece includes at least one groove therein.

12. A pump impeller assembly, comprising:

a first impeller piece having a first mating surface thereon; and a second impeller piece having a second mating surface therein, the second mating surface of said second impeller piece being sized to mate with the first mating surface of said first impeller piece, the second mating surface of said second impeller piece having at least one groove therein, said second impeller piece being mounted to said first impeller piece so that the second mating surface fits against the first mating surface, the groove in the second mating surface together with the first mating surface defining at least one flow channel in said impeller assembly.

13. The pump impeller assembly of claim 12, wherein the first mating surface of said first impeller piece comprises a concave surface and wherein the second mating surface of said second impeller piece comprises a convex surface.

14. The pump impeller assembly of claim 13, wherein said concave surface and convex surface comprise truncated cones.

15. The pump impeller assembly of claim 13, wherein said concave surface and said convex surface comprise conic sections.

16. The pump impeller assembly of claim 12, wherein said second impeller piece comprises a substantially circular configuration having a concentric inlet opening therein and an outer circumference, the groove in the second mating surface of said second impeller piece extending from the concentric inlet opening to the outer circumference.

17. The pump impeller assembly of claim 16, wherein said at least one flow channel has a first cross-sectional area at the concentric inlet opening and a second cross-sectional area at the outer circumference, the first cross-sectional area being greater than the second cross-sectional area.

18. The pump impeller assembly of claim 17, wherein the second mating surface of said second impeller piece includes a tangential groove therein at about the outer circumference, said tangential groove being continuous with the groove in the second mating surface of said second impeller.

19. A pump, comprising:

housing means for defining a pump inlet and a pump outlet;

two-piece impeller means mounted for rotation within said housing means for providing a flow channel therein defined between two mating pieces of said two-piece impeller means; and drive means operatively associated with said two-piece impeller means for rotating said two-piece impeller means within said housing means.

20. A pump, comprising:

a housing having a fluid inlet and an fluid outlet, said housing defining a generally cylindrically shaped volume therein having a central axis;

an impeller assembly mounted for rotation within the generally cylindrically shaped volume by said housing, said impeller assembly comprising:

a substantially circular first impeller piece having an outer circumference and a first mating surface thereon;

a substantially circular second impeller piece having a concentric inlet opening therein and an outer circumference, said substantially circular second impeller piece having a second mating surface therein sized to mate with the first mating surface of said substantially circular first impeller piece, the second mating surface having a groove therein extending from the concentric inlet opening and the outer circumference, said substantially circular second impeller piece being mounted to said substantially circular first impeller piece so that at least one flow channel is defined by the groove in the second mating surface of said second impeller piece and the first mating surface of said first impeller piece; and a drive system operatively associated with said impeller assembly, said drive system rotating said impeller assembly within said housing.

21. The pump of claim 20, wherein the second mating surface of said second impeller piece includes a tangential groove therein at about the outer circumference, said tangential a groove being continuous with the groove in the second mating surface of said second impeller.

* * * * *